United States Patent [19]

Tabor

[11] Patent Number: 4,995,530

[45] Date of Patent: Feb. 26, 1991

[54] ADJUSTABLE DISPENSER FOR HOLDING BOXES OF PLASTIC BAGS

[76] Inventor: Carroll Tabor, 2502 Highway 1, Thibodaux, La. 70301-5843

[21] Appl. No.: 278,595

[22] Filed: Dec. 1, 1988

[51] Int. Cl.[5] ..... B65H 1/00

[52] U.S. Cl. ..... 221/46; 221/61; 221/63; 221/281; 221/286; 221/287; 248/905

[58] Field of Search ..... 221/46, 44, 197, 45, 221/61, 63, 281, 282, 286, 287; 248/DIG. 5, 316.1, 905

[56] References Cited

U.S. PATENT DOCUMENTS

| | | | |
|---|---|---|---|
| 1,925,678 | 9/1933 | Samson | 221/46 |
| 2,884,162 | 4/1959 | Crebbs | 221/46 |
| 2,958,496 | 11/1960 | Johnson | 221/46 |
| 3,724,716 | 4/1973 | Baraconi et al. | 221/61 X |
| 4,175,673 | 11/1979 | McDonald et al. | 221/63 |
| 4,805,800 | 2/1989 | Nocek et al. | 221/63 |

*Primary Examiner*—Kevin P. Shaver

*Assistant Examiner*—David H. Bollinger

*Attorney, Agent, or Firm*—Pravel, Gambrell, Hewitt, Kimball & Krieger

[57] ABSTRACT

An adjustable dispenser container for holding boxes of plastic bags that are usually stored on a roll or packed individually side-by-side within a box to be dispensed from the box via a slot including a housing having sidewalls, a bottom, a top and a longitudinal axis intersecting the bottom and top. One of the walls includes a longitudinally extending slot. The slot is generally parallel to the longitudinal axis of the box. An adjusting spring in the form of a pair of spaced apart leafs is provided interiorly of the body for frictionally holding the box with respect to the body in a position that registers the slot of the box with the longitudinal slot of the housing so that plastic bags can be dispensed simultaneously through both the first and the second slots and the springs deforming when the box is placed in the housing so that boxes of varying sizes can be used in the housing.

7 Claims, 1 Drawing Sheet

ADJUSTABLE DISPENSER FOR HOLDING BOXES OF PLASTIC BAGS

BACKGROUND OF THE INVENTION

1. Field of the Invention

The present invention relates to plastic bag dispensers and more particularly to an outer permanent housing for containing dispensable cardboard boxes of plastic storage bags that can be of varying sizes, wherein the housing has springs which, (1) align dispensing openings of the cardboard box and the housing, (2) adjust to grip boxes of various widths, and (3) secure the cardboard box during use from movement.

2. General Background

Several types and sizes of disposable plastic storage bags are provided in roll form or packed tightly side by side within a cardboard disposable box. These bags are used for lining garbage cans and garbage pails, for collecting debris such as leaves and grass cuttings, and for storing food items such as frozen fish, vegetables, and the like. Disposable storage bags can be clear, or colored such as white or black. Plastic storage bags come in varying sizes and the cardboard boxes which contain them also have varying dimensions though they are typically rectangular or square in cross-sections. Many commercially available disposable cardboard boxes containing plastic bags provide a longitudinally extending slot. Oftentimes, the slot is closed when the box is purchased and the slot is opened by tearing off a serrated cardboard member. Storage bags are commercially available, and are sold under the following trademarks for example, "Zip-Lock", "Glad" bag, "Hefty" bag, and others which are well known.

A problem exists in that these boxes differ in dimensions from manufacturer to manufacturer and also from size to size. A sloppy storage problem is created when a particular household has food storage bags, trash bags, lawn clean-up bags, and others which are of various sizes. Typically, these boxes are stacked upon shelves where they are difficult to access and generally create clutter.

Dispensers are commonly available for dispensing paper products such as e.g., tissue, towels, and disposable cups. For example U.S. Pat. No. 282,785 issued to Shoff entitled "Closet Paper Holder", shows a container having a forwardly opening lid with a leaf spring positioned on the rear surface of the lid for forcing paper products forwardly.

A paper towel dispenser is the subject of U.S. Pat. No. 2,884,162 issued to Crebbs and entitled "Dispenser Containers".

The Hope U.S. Pat. No. 2,081,177 shows an example of a cup dispenser which has a longitudinally, vertically extending housing having a lowermost open bottom with tabs that secure the cups and allows them to be withdrawn one at a time.

Some patents relate to the problem of dispensing a stack of cards one at a time such as can be seen in the Joy U.S. Pat. No. 622,807 and in the Hansen U.S. Pat. No. 4,623,073.

The Thomasma U.S. Pat. No. 2,299,940 entitled "Paper Towel and Seat Cover Dispenser" shows a housing having a dispensing opening with storage for a plurality of flexible paper members contained within the housing.

A dispenser for storage bags is the subject of U.S. Pat. No. 2,811,280 issued to Comisso.

These prior art patents deal primarily with the problem of dispensing loose items which are not contained within an overall disposable box structure that can be of various sizes. Thus, these patents deal with products that are put inside of a dispenser which is specifically sized to contain the particular product being dispensed, thus not able to handle product variation.

Unfortunately, with plastic bags such as trash bags, storage bags and the like, the size of the item varies widely as does the size of the disposable cardboard box in which they are contained. These prior references do not provide an automatic adjustable tensioning mechanism which registers the box in a proper dispensing position with respect to the housing so that boxes of various sizes can be used within a single dispenser and for dispensing bags from a roll or from a stacked arrangement.

SUMMARY OF THE PRESENT INVENTION

Thus, the present invention solves these prior art problems and shortcomings in a simple straightforward yet workable manner. The present invention provides an adjustable dispenser container for holding boxes of plastic bags stored in a pack or rolled manner within a cardboard box and to be dispensed from the cardboard box via a slot. The apparatus includes a housing having sidewalls, a bottom, a top and a longitudinal axis intersecting the bottom and top. One of the walls includes a longitudinally extending housing slot. Adjustable springs preferably in the form of a pair of spaced apart leaf springs positioned on opposite sides of the box are provided internally of the body for frictionally holding the cardboard box with respect to the body in a position which registers the dispensing slot of the disposable box with the longitudinal dispensing slot of the housing, so that plastic bags can be dispensed simultaneously through the aligned slots, and the springs deforming when the box is placed in the housing so that boxes of varying sizes can be used within the housing.

In the preferred embodiment, the sidewalls include four rectangular sidewalls orthogonally placed with respect to each other, with the leaf springs being disposed on the opposite sidewalls.

In the preferred embodiment, the top wall provides an opening so that cardboard dispensing boxes can be added to and removed from the housing interior via the top. As an alternative, the front wall, bottom, or another side wall could be removed so that boxes can be added to the housing.

In the preferred embodiment, the bottom includes an opening which allows manual contact with a cardboard box contained within the housing so that a person can push and empty the cardboard box upwardly after dispensing of all bags therefrom is completed.

BRIEF DESCRIPTION OF THE DRAWINGS

For a further understanding of the nature and objects of the present invention, reference should be had to the following detailed description, taken in conjunction with the accompanying drawings, in which like parts are given like reference numerals, and wherein.

DETAILED DESCRIPTION OF THE PREFERRED EMBODIMENT

Figure 1:
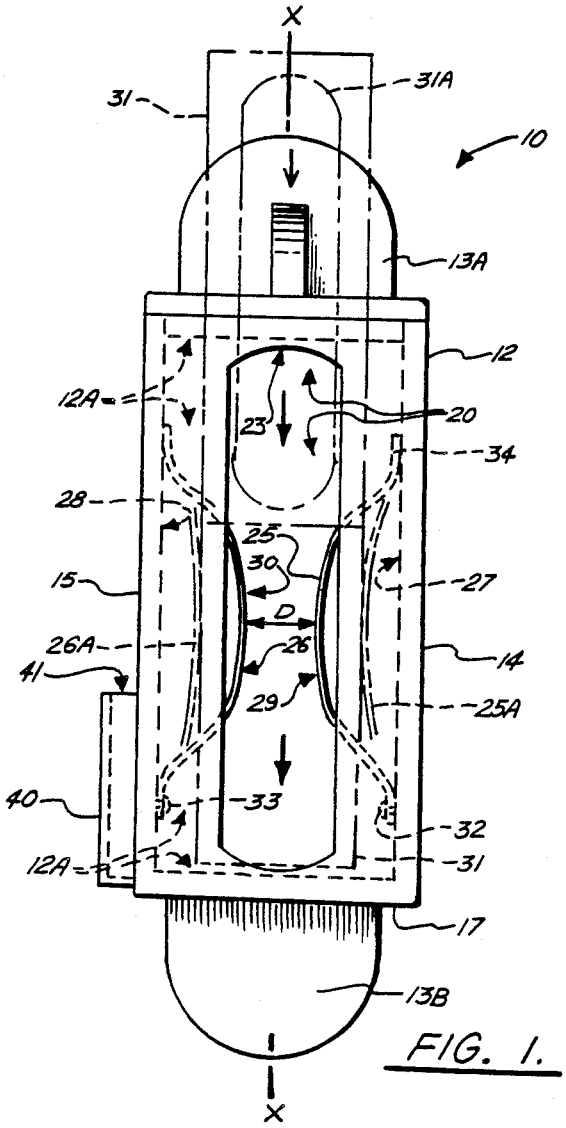
FIG. 1 is a front elevational view of the preferred embodiment of the apparatus of the present invention.
Figure 2:
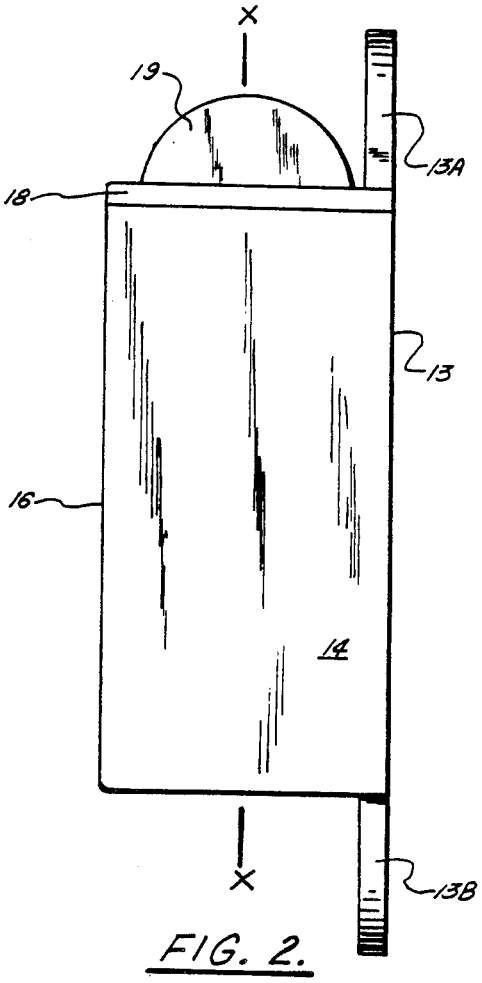
FIG. 2 is a side view of the preferred embodiment of the apparatus of the present invention.
Figure 3:
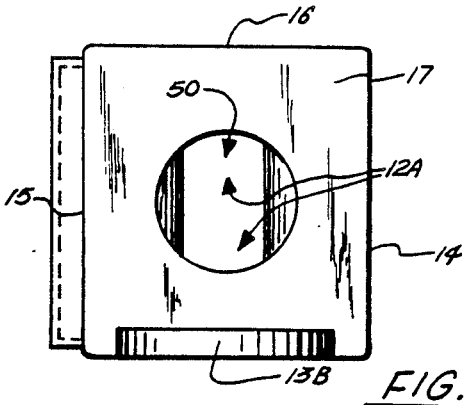
FIG. 3 is a bottom view of the preferred embodiment of the apparatus of the present invention.
Figure 4:
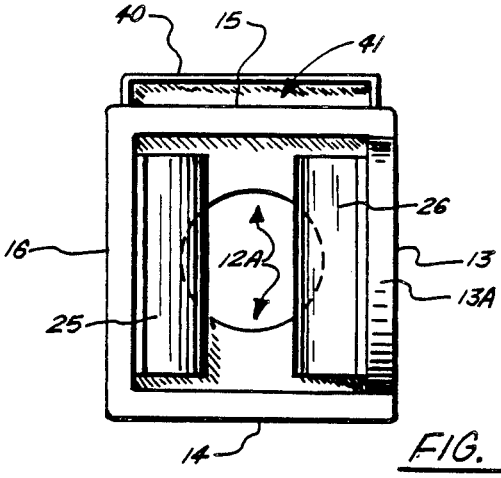
FIG. 4 is a top view of the preferred embodiment of the apparatus of the present invention showing the removable lid portion removed therefrom.

FIGS. 1–4 best illustrate the preferred embodiment of the apparatus of the present invention designated generally by the numeral 10. The adjustable dispenser container 10 of the present invention includes a housing 12 having sidewalls 13, 14, 15, 16. The housing also includes a bottom 17 and a top 18 which is preferably removable, having handle 19 which can be a semicircular member such as is shown in FIGS. 1 and 2.

The front wall 16 includes a longitudinally extending slot 20 defined by edges 21, 22 and by ends 23, 24. In the preferred embodiment, the sidewalls 13–16 are preferably rectangular and are orthogonally connected so that the housing 12 end portions include bottom 17 and top 18 which are generally rectangular and of the same size. Thus, the center of bottom 17 and the center of top 18 define points which are intersected by a longitudinal axis X—X, of the housing 12 as shown in FIGS. 1 and 2.

A pair of spaced apart flexible leaf springs 25, 26 (see FIG. 1) are provided respectively on the interior surfaces 27, 28 of sidewalls 14, 15 of housing 12. Each leaf spring 25, 26 is preferably of a flexible plastic material such as polypropylene or the like having a memory. Each leaf spring 25, 26 has an outermost surface 29, 30 which extends away from the respective surfaces 27, 28 to define therebetween a dimension D which is preferably smaller than or equal to the width W of slot 20. Yet, the leaf springs 25, 26 can deflect when a disposable cardboard box 31 containing plastic bags, is added to the interior 12A of housing 12. In FIG. 1, the numerals 25A, 26A denote a deflected position of leaf springs 25, 26 after cardboard box 31 has been added to container interior 12A. In the preferred embodiment, the leaf springs 25, 26 are attached by rivets, glue, screws or the like at one end portion 32, 33 respectively so that the opposite end portion 34, 35 of each leaf spring 25, 26 can slide upon and with respect to its respective sidewall 14, 15 as when a box 31 is added to housing 12 interior 12A, moving surfaces 29, 30 apart.

One skilled in the art will thus notice that the leaf springs 25, 26 automatically deflect to accommodate cardboard boxes 31 of different cross-sectional dimensions. Further, the housing slot 20 is sufficiently large so that a corresponding slot 31A of cardboard box 31 will have sufficient room to align and register therewith. The plastic bag product can then be dispensed simultaneously via the slot 31 of the box and via the slot 20 of the housing 12. Thus, the leaf springs 25, 26 function to register the slot 31A of cardboard box 31 with the slot 20 of housing 12. Secondly, the leaf springs 34, 35 are of a spring-like construction having memory which holds the box 31 securely therebetween thus preventing substantial movement of the box during dispensing of bags from cardboard box 31 and housing 12. Thirdly, the deflection of leaf springs 25, 26 laterally define a variable width to the housing interior for accommodating boxes 31 of various sizes.

An optional holder 40 can be attached to one of the sidewalls 15 for example providing a slot 41 for containing plastic ties or the like to be used with the plastic bags as a closure member.

The apparatus 10 can be manufactured of any suitable structure material such as wood, plastic, metal or the like.

The wall 13 can include a pair of elongated portions 13A, 13B extending respectively above top 18 and below bottom 17 for providing mounting tabs for attaching the housing 12 to a wall for example using wood screws or the like.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as invention is:

1. An adjustable dispenser container for holding a disposable box of plastic bags stored within the box, to be dispensed from the box via an elongated slot that extends substantially the length of the box, comprising:

(a) a housing having sidewalls, a bottom end wall, a top end wall and a longitudinal axis intersecting the bottom and top defining therewithin a hollow interior;

(b) one of the walls having an elongated dispensing housing opening therein communicating with the interior;

(c) adjusting spring means within the housing for frictionally holding the box with respect to the body in a position which registers the slot of the box with the opening of the housing so that plastic bags can be dispensed through the registered slot and opening; and (d) the spring means comprising left and right opposed leaf springs, each having inwardly facing surfaces movable with respect to each other so that the width of the interior of the housing varies by automatic displacement laterally of the leaf springs over their length when the box is placed in the housing between the leaf springs, so that boxes of varying sizes can be contained in the housing; and (e) the leaf springs being fixedly attached at one end portion to the housing and being free to move and displace at the opposite end portion thereof.

2. The apparatus of claim 1 wherein the housing sidewalls are generally rectangular and include four sidewalls which are orthogonally connected.

3. The apparatus of claim 1 wherein the top and bottom of the housing are of substantially the same size and define centers which are intersected by the longitudinal axis of the housing.

4. The apparatus of claim 1 further comprising an opening in one of the end walls so that the disposable box contained within the housing can be manually contacted for aiding in removal of the box when it is empty.

5. The apparatus of claim 1 wherein at least one of the sidewalls is removable.

6. The apparatus of claim 1 wherein the left and right opposed leaf springs are mounted respectively on opposite sides of the longitudinal axis of the housing, a middle section of each leaf spring including an inwardly extending curved surface providing an outermost convex surface that contacts the disposable box contained between the leaf springs during use, and the leaf spring free end portions defining surfaces that moveably contact the housing inner wall during use.

7. An apparatus of claim 1 wherein the left and right opposed leaf springs each have extended surfaces for contacting a disposable box of plastic bags that define the closest distance between the leaf springs, that distance being substantially equal to or smaller than the transverse width of the opening.

* * * * *